US007156322B1

(12) United States Patent
Heitzman

(10) Patent No.: US 7,156,322 B1
(45) Date of Patent: Jan. 2, 2007

(54) IRRIGATION SPRINKLER UNIT WITH CYCLING FLOW RATE

(76) Inventor: Charles J. Heitzman, 1330 Ala Moana Blvd., Honolulu, HI (US) 96813

( * ) Notice: Subject to any disclaimer, the term of this patent is extended or adjusted under 35 U.S.C. 154(b) by 164 days.

(21) Appl. No.: 10/947,107

(22) Filed: Sep. 22, 2004

Related U.S. Application Data

(60) Provisional application No. 60/504,473, filed on Sep. 22, 2003.

(51) Int. Cl.
*B05B 3/04* (2006.01)

(52) U.S. Cl. ..... 239/240; 239/200; 239/201; 239/237; 239/225.1; 137/625.11

(58) Field of Classification Search ..... 239/225.1, 239/237, 263, 200, 201, 202, 380, 381; 137/625.11
See application file for complete search history.

(56) References Cited

U.S. PATENT DOCUMENTS 3,642,022 A * 2/1972 Kirby ..... 137/119.03
3,733,030 A * 5/1973 Carstenson ..... 239/205
4,026,471 A 5/1977 Hunter
4,624,412 A * 11/1986 Hunter ..... 239/232
4,773,595 A 9/1988 Livne
4,892,252 A 1/1990 Bruninga
4,971,250 A 11/1990 Hunter
5,009,368 A * 4/1991 Streck et al. ..... 239/70
5,174,501 A 12/1992 Hadar
5,526,982 A 6/1996 McKenzie
5,662,545 A 9/1997 Zimmerman et al.
5,785,248 A * 7/1998 Staylor et al. ..... 239/237
6,186,413 B1 * 2/2001 Lawson ..... 239/205
6,193,169 B1 * 2/2001 Steinhilber et al. ..... 239/240
6,241,158 B1 * 6/2001 Clark et al. ..... 239/1
6,490,740 B1 * 12/2002 Gardenier et al. ..... 4/541.1
6,622,933 B1 * 9/2003 Young et al. ..... 239/66
6,634,571 B1 * 10/2003 Shimazu ..... 239/381
6,655,830 B1 * 12/2003 Seaman ..... 366/168.2
6,672,336 B1 * 1/2004 Nichols ..... 137/625.46
6,779,557 B1 * 8/2004 Weiss ..... 137/624.13
6,789,573 B1 * 9/2004 Knapp ..... 137/625.15
6,799,604 B1 * 10/2004 Samwell et al. ..... 137/597
6,814,304 B1 * 11/2004 Onofrio ..... 239/201
6,840,460 B1 * 1/2005 Clark ..... 239/205
6,869,026 B1 * 3/2005 McKenzie et al. ..... 239/237
6,883,727 B1 * 4/2005 De Los Santos ..... 239/240
6,904,936 B1 * 6/2005 Ma ..... 137/625.47
6,921,030 B1 * 7/2005 Renquist ..... 239/380
6,929,194 B1 * 8/2005 Lawson ..... 239/205
6,935,372 B1 * 8/2005 Dando et al. ..... 137/625.43
6,942,164 B1 * 9/2005 Walker ..... 239/204
6,945,471 B1 * 9/2005 McKenzie et al. ..... 239/237
6,991,362 B1 * 1/2006 Seaman ..... 366/168.2
6,997,213 B1 * 2/2006 Towler et al. ..... 137/625.46
7,000,636 B1 * 2/2006 Dando et al. ..... 137/625.46

(Continued)

*Primary Examiner*—David A. Scherbel
*Assistant Examiner*—Trevor McGraw
(74) *Attorney, Agent, or Firm*—Jacox, Meckstroth & Jenkins

(57) ABSTRACT

An irrigation sprinkler unit includes a tubular housing enclosing a speed reducing drive which is driven by a water actuated turbine wheel and rotates a rotary nozzle head at a substantially slower speed. The drive also rotates a tubular valve member within an annular valve body within the housing, and the valve member and valve body have cooperating radial ports which automatically and continuously vary the flow rate of water through the housing for continuously varying the radial distance of a water stream discharged from the nozzle head.

15 Claims, 2 Drawing Sheets

U.S. PATENT DOCUMENTS

2002/0153432 A1* 10/2002 McKenzie et al. ..... 239/237
2003/0015606 A1* 1/2003 Cordua ..... 239/457
2003/0075618 A1* 4/2003 Shimazu ..... 239/381
2003/0150935 A1* 8/2003 Renquist ..... 239/214
2004/0046047 A1* 3/2004 Townsend ..... 239/242
2004/0050958 A1* 3/2004 McKenzie et al. ..... 239/242
2004/0108391 A1* 6/2004 Onofrio ..... 239/201
2004/0164178 A1* 8/2004 Kah, Jr. ..... 239/237
2004/0195358 A1* 10/2004 Santiago et al. ..... 239/200
2004/0195362 A1* 10/2004 Walker ..... 239/252
2005/0040256 A1* 2/2005 Santos ..... 239/380
2005/0082387 A1* 4/2005 Onofrio ..... 239/200

* cited by examiner

IRRIGATION SPRINKLER UNIT WITH CYCLING FLOW RATE

BACKGROUND OF THE INVENTION

In the art of rotary irrigation sprinklers, for example, of the pop-up type disclosed in U.S. Pat. Nos. 4,026,471, 4,773,595, 4,892,252, 4,971,250, 5,174,501 and 5,526,982, it has been found desirable to vary the flow rate of water flowing through the sprinkler and discharged from the nozzle head as it rotates to provide a more uniform radial distribution of water from the nozzle head, regardless of whether the water is discharged in a single stream from a single nozzle orifice or is discharged from multiple orifices in the nozzle head. Uniform radial distribution of water is desirable whether the water is being distributed in a full circular pattern or in a part circular pattern.

SUMMARY OF THE INVENTION

The present invention is directed to an improved rotary irrigation or water sprinkler which may be of the pop-up type or a rotary sprinkler which does not have a pop-up nozzle head. The irrigation sprinkler of the invention provides for automatically varying the flow rate of water through the sprinkler and thereby automatically varying the radial distance the water is discharged from the nozzle head of the sprinkler unit as the head rotates. In accordance with a preferred embodiment, the sprinkler of the invention includes a tubular housing supporting a valve body enclosing a rotary valve member which is driven by the output shaft of a speed reducing drive having an input driven by a water activated rotary turbine wheel. The output shaft of the speed reducing drive or transmission also rotates the nozzle head of the sprinkler unit. The valve member rotates within the valve body, and radial ports within the valve member cooperate with radial ports within the surrounding valve body to provide the variable flow rate of water through the sprinkler unit and into the nozzle head. The size and shapes of the ports may be designed to provide the desired variable radial flow rate of water from the rotary nozzle head of the sprinkler unit.

Other features and advantages of the invention will be apparent from the following description, the accompanying drawings and the appended claims.

DESCRIPTION OF THE PREFERRED EMBODIMENT

Figure 1:
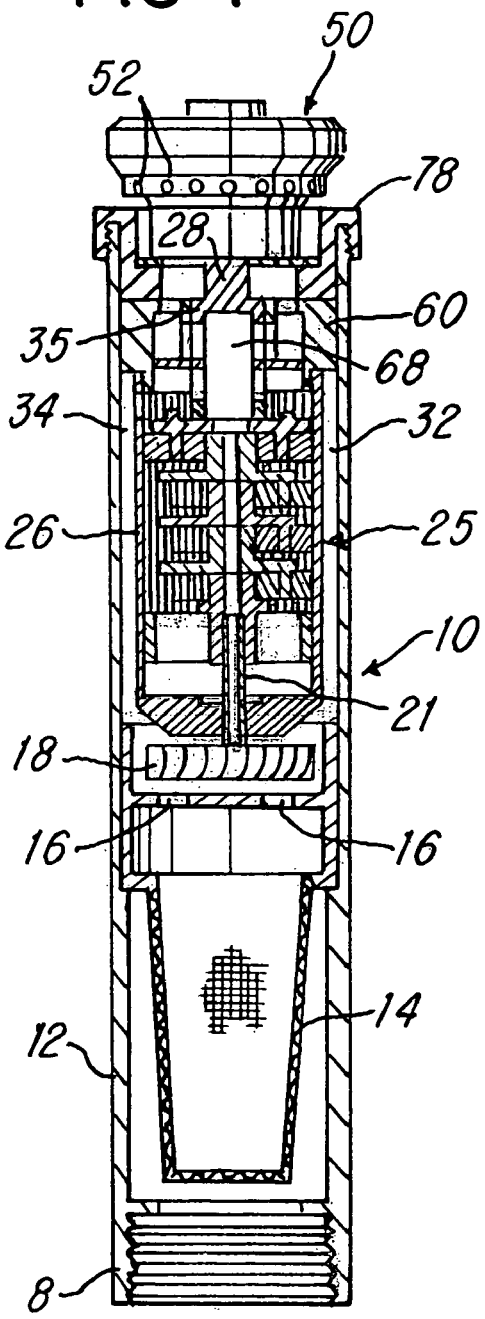
FIG. 1 is an axial section through a commercially available irrigation sprinkler unit modified in accordance with the invention.

Referring to FIG. 1, pressurized water flows from a supply line or pipe (not shown) connected to the lower end portion 8 of an irrigation sprinkler unit 10 assembled with parts or components molded of plastic materials. The water flows upwardly within the tubular housing 12 and through a plastic filter screen 14 and then through diametrically opposed inclined jet openings 16 to start rotation of a turbine wheel 18. The turbine wheel 18 drives a tubular input shaft 21 of a speed reducing unit or drive 25 having a tubular housing 26 within an internal spline or gear teeth forming part of a planetary gear train having a rotary output shaft 28 at the top of the sprinkler unit 10. The detail construction of the speed reducing unit or drive 25 is disclosed in U.S. Pat. Nos. 5,662,545 and 5,785,248, issued to The Toro Company, and the disclosures of which are herein incorporated by reference. The housing 26 is spaced concentrically within the tubular housing 12 by axially extending ribs 32 molded as an integral part of the housing 26 and defining circumferentially spaced passages 34 extending from the bottom of the speed reducing unit 25 to the top of the unit, as shown in FIG. 1.

Figure 2:
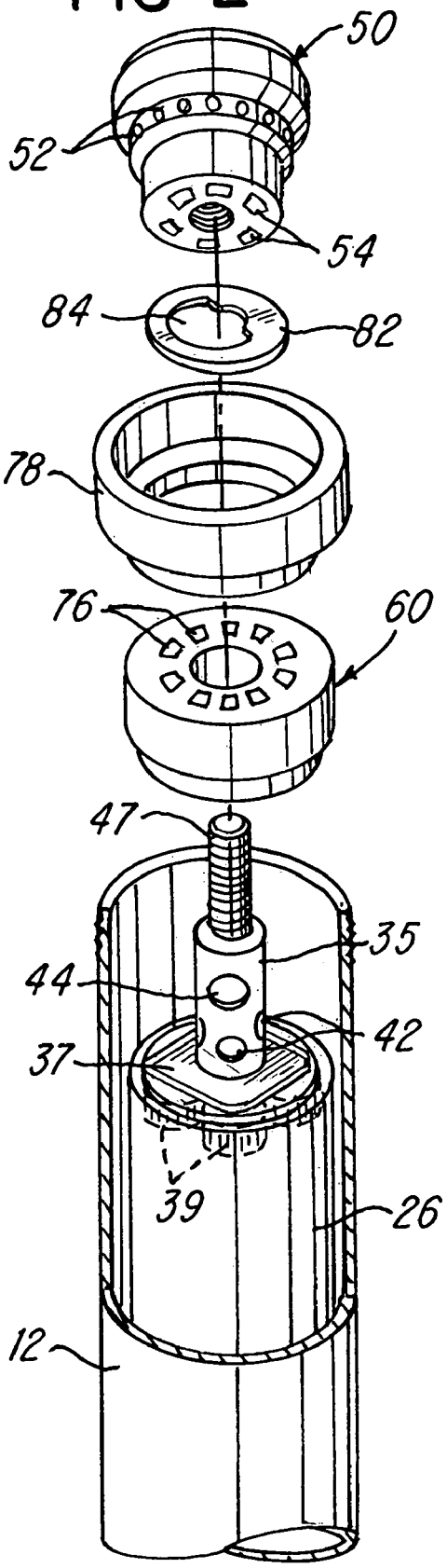
FIG. 2 is an exploded view of an upper portion of the sprinkler unit shown in FIG. 1 and modified in accordance with the invention.
Figure 3:
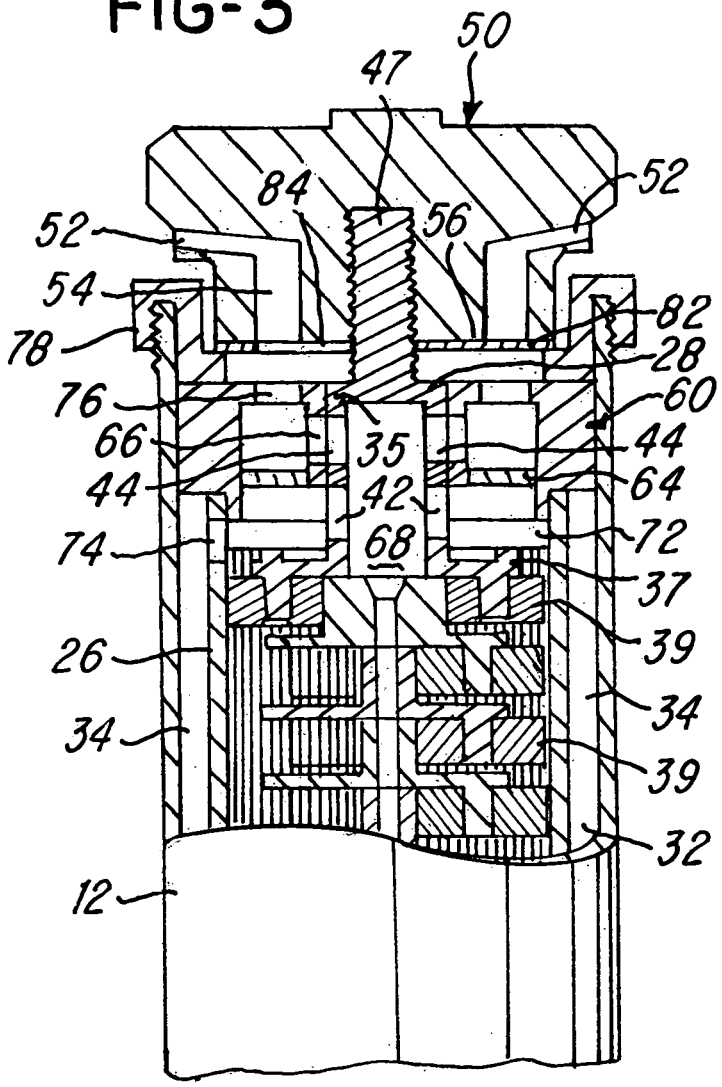
FIG. 3 is an enlarged axial section of the upper portion shown in FIG. 2.
Figure 4:
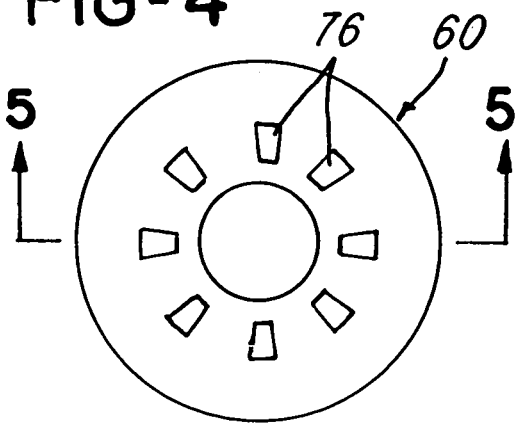
FIG. 4 is a plan view of the annular valve body shown assembled in FIG. 3.
Figure 5:
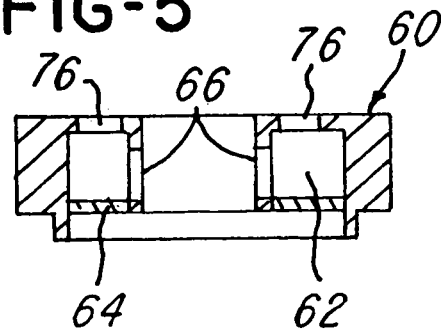
FIG. 5 is an axial section of the valve body, taken on the line 5—5 of FIG. 4.

Referring to FIG. 3, the rotary output shaft 28 includes a tubular and cylindrical rotary valve member 35 which projects upwardly from an integral bottom flange portion 37 which carries an upper set of planetary gears 39 for the speed reducing unit 25. A set of radial ports 42 are formed within a lower portion of the tubular valve member 35, and a set of circumferentially spaced radial ports 44 are formed within an upper portion of the valve member 35. The combined output shaft 28 and valve member 35 also includes a threaded shaft or stud portion 47 which receives a rotary nozzle head member 50 having a series of circumferentially spaced nozzle openings or orifices 52, as shown in FIGS. 1–3. The nozzle openings 52 connect with passages 54 which extends within the nozzle head 50 to a flat bottom surface 56 on the nozzle head 50.

An annular valve body 60 (FIGS. 2–5) seats on the upper end of the inner tubular housing 26 and is confined within the upper end portion of the outer housing 12. The valve body 60 surrounds the valve member 35 and defines an annular chamber 62 which is closed by an annular bottom plate 64. Diametrically opposed ports 66 are formed within the valve body 60 and are positioned to align or connect with the ports 44 formed within the rotary valve member 28 and extending from a central chamber 68 within the valve member 28. The passage or chamber 68 is connected by the ports 42 to an annular chamber 72 surrounding the valve member 28.

The upper end portion of the inner tubular housing 26 has circumferentially spaced holes or ports 74 which connect the passages 34 to the chamber 72 so that water flowing upwardly from the turbine wheel 18 through the passages 34 flows inwardly through the ports 74 and into the chamber 72 and then through the ports 42 into the chamber 68 within the rotary valve member 28. The valve body 60 has a top wall with circumferentially spaced openings 76 connected to the chamber 62. An annular retaining cap 78 is threaded onto the upper end portion of the outer tubular housing 12 and retains the valve body 60 against the upper end of the inner tubular housing 26.

As shown in FIGS. 2 & 3, a circular metal pattern plate 82 surrounds the threaded stud 47 and seats on the retaining cap 78. The retaining plate defines an aperture or opening 84 which determines the arcuate spray pattern of water discharged in streams from the nozzle openings 52. As shown in FIG. 2, the opening 84 is semi-circular to produce a 180° spray pattern or half circle irrigation mode. The pattern plate 82 is interchangeable with other pattern plates having different openings 84 after the nozzle head 50 is unthreaded from the stud 47 in order to obtain a different arcuate spray pattern. The plate 82 also forms a rotary seat and seal with the bottom surface of the sprinkler head 50.

In operation, the water flowing upwardly through the passages 34 and into the center chamber 68 flows radially outwardly through the ports 44 and 66 when the ports 44 are connected with the port 66. As the valve member 28 rotates with the nozzle head 50, the port 66 are slowly closed and slowly opened by rotation of the ports 44 within the valve body 60. Thus the water flowing into the annular chamber 62 within the valve body 60 and upwardly through the ports 76 and into the passages 54 within the nozzle head 50 cycles between a lower flow and a higher flow rate. As a result, the streams discharge from the nozzle openings 52 move between a maximum radially distance and a minimum radial distance, thereby obtaining more uniform radial distribution of the water as the nozzle head 50 rotates. The more uniform radial distribution of the water from the sprinkle unit 10 also results in a savings of water when it is desired to distribute a predetermined volume of water uniformly over a particular ground area. For example, while a commercially available irrigation unit may produce 2.5 gallons per minute (gpm) of non-uniform water distribution, cycling of water flow through ports 44 and 66 of the sprinkler unit 10 may produce about 2.2 gpm of uniform water distribution. Thus the irrigation unit 10 provides approximately 15% savings of water as a result of the more uniform radial distribution of the water from the irrigation unit.

While the form of sprinkler unit herein described constitutes a preferred embodiment of the invention, it is to be understood that the invention is not limited to this precise form, and that changes may be made therein without departing from the scope and spirit of the invention as defined in the appended claims. For example, the speed reducing drive 25 may be another form of reducing drive which is not a self-contained unit, or the rotary nozzle head 50 may have a drive separate from the drive for the rotary valve member.

What is claimed is:

1. An irrigation sprinkler unit comprising a housing, a rotary valve member supported for rotation within said housing, a water activated rotary turbine wheel disposed within said housing, a speed reducing drive connecting said turbine wheel to said valve member for rotating said valve member at a speed substantially slower than a speed of said turbine wheel in response to the flow of water through said housing, a passage for directing water flowing through said housing, said rotary valve member having a portion variably restricting the flow of water through said passage while said valve member is rotating at said substantially slower speed for automatically and continuously varying the flow rate of water through said housing, a nozzle head member connected to said valve member for rotation therewith, and said head member defining at least one nozzle orifice for discharging water flowing through said housing in a water stream forming a spray pattern.

2. A sprinkler unit as defined in claim 1 and including an annular non-rotating valve body confined within said housing and surrounding said rotary valve member, and said valve member and said valve body having radial ports cooperating to vary the flow rate of water through said housing in response to rotation of said valve member.

3. A sprinkler unit as defined in claim 2 wherein said valve member includes a tubular portion having a set of axially spaced said radial ports.

4. A sprinkler unit as defined in claim 1 wherein said rotary valve member includes an upper stud portion with external threads for attaching said head member to said valve member.

5. A sprinkler unit as defined in claim 4 wherein said stud portion is integrally connected to said rotary valve member, and said valve member is integrally connected to a lower flange supporting gears of said speed reducing drive.

6. A sprinkler unit as defined in claim 1 and including an annular valve body within said housing and defining an annular chamber, said valve body having a top wall with circumferentially spaced ports connected to said chamber, and said valve body including an inner cylindrical wall having circumferentially spaced said ports and supporting said valve member for rotation.

7. An irrigation sprinkler unit comprising a tubular housing having a lower end portion adapted to receive a supply of water, a speed reducing drive within said housing and having a lower input shaft connected to a turbine wheel positioned to rotate in response to water flowing through said housing, a rotary valve member driven by said speed reducing drive at a speed substantially slower than a speed of said turbine wheel, a stationary valve member adjacent said rotary valve member and confined within said housing, a nozzle head member connected to said rotary valve member for rotation therewith, said head member having at least one nozzle orifice for discharging a water stream, and said rotary valve member and said stationary valve member cooperating to vary automatically and continuously the flow rate of water through said housing in response to rotation of said rotary valve member to provide for continuously varying the radial distance of the water stream discharged from said orifice in said nozzle head.

8. A sprinkler unit as defined in claim 7 wherein said stationary valve member comprises an annular valve body surrounding said rotary valve member, and said rotary valve member and said valve body have radial ports cooperating to vary the flow rate of water through said housing in response to rotation of said rotary valve member.

9. A sprinkler unit as defined in claim 8 wherein said rotary valve member includes a tubular portion having a set of axially spaced said radial ports.

10. A sprinkler unit as defined in claim 7 wherein said rotary valve member includes an upper stud portion with external threads for attaching said head member to said rotary valve member.

11. A sprinkler unit as defined in claim 10 wherein said stud portion is integrally connected to said rotary valve member, and said rotary valve member is integrally connected to a lower flange supporting at least one gear of said speed reducing drive.

12. A sprinkler unit as defined in claim 7 wherein said stationary valve member comprises an annular said valve body within said housing and defining an annular chamber, said valve body having a top wall with circumferentially spaced ports connected to said chamber, and said valve body including an inner cylindrical wall having circumferentially spaced said ports connected to said chamber and supporting said rotary valve member for rotation.

13. An irrigation sprinkler unit comprising a housing, a rotary valve member supported for rotation within said housing, a water activated rotary turbine wheel disposed within said housing, a speed reducing drive connecting said turbine wheel to said valve member for rotating said valve member at a speed substantially slower than a speed of said turbine wheel in response to the flow of water through said housing, a passage for directing water flowing through said housing while said valve member is rotating at said substantially slower speed, said valve member having a portion variably restricting the flow of water through said passage in response to rotation of said valve member for automatically and continuously varying the flow rate of water through said housing, a nozzle head member supported for rotation and connected to receive water from said rotary valve member, and said head member defining at least one nozzle orifice for discharging water flowing into said head member in a water stream forming a spray pattern.

14. A sprinkler unit as defined in claim 13 and including an annular valve body surrounding said rotary valve member, and said valve member and said valve body having radial ports cooperating to vary the flow rate of water through said housing in response to rotation of said valve member.

15. A sprinkler unit as defined in claim 13 and including an annular valve body within said housing and defining an annular chamber, said valve body having a top wall with circumferentially spaced ports connected to said chamber, and said valve body including an inner cylindrical wall having circumferentially spaced said ports and supporting said valve member for rotation.

* * * * *